US009419329B1

(12) United States Patent
West et al.

(10) Patent No.: US 9,419,329 B1
(45) Date of Patent: Aug. 16, 2016

(54) MULTI-SENSOR SYSTEM AND METHOD FOR VEHICLES

(71) Applicants: James B. West, Cedar Rapids, IA (US); Lee M. Paulsen, Cedar Rapids, IA (US); Daniel L. Woodell, Holts Summit, MO (US)

(72) Inventors: James B. West, Cedar Rapids, IA (US); Lee M. Paulsen, Cedar Rapids, IA (US); Daniel L. Woodell, Holts Summit, MO (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 14/819,083

(22) Filed: Aug. 5, 2015

Related U.S. Application Data

(63) Continuation of application No. 13/831,035, filed on Mar. 14, 2013, now Pat. No. 9,118,112.

(51) Int. Cl.
*H01Q 1/27* (2006.01)
*H01Q 1/28* (2006.01)

(52) U.S. Cl.
CPC ..... *H01Q 1/281* (2013.01); *H01Q 1/288* (2013.01)

(58) Field of Classification Search
CPC ..... H01Q 1/27; H01Q 1/28; H01Q 1/281; H01Q 11/00
USPC ..... 343/705
See application file for complete search history.

(56) References Cited

U.S. PATENT DOCUMENTS

| | | | | |
|---|---|---|---|---|
| 3,953,857 | A * | 4/1976 | Jenks | H01Q 3/34 342/373 |
| 5,488,375 | A | 1/1996 | Michie | |
| 5,805,111 | A | 9/1998 | Brettner et al. | |
| 7,023,375 | B2 | 4/2006 | Klausing et al. | |
| 7,180,476 | B1 | 2/2007 | Guell et al. | |
| 7,532,170 | B1 | 5/2009 | Lee et al. | |
| 8,159,394 | B2 | 4/2012 | Hayes et al. | |
| 8,359,026 | B2 | 1/2013 | De La Chapelle et al. | |
| 8,428,580 | B1 | 4/2013 | Mitchell et al. | |
| 8,437,888 | B2 | 5/2013 | Bibaut | |
| 8,791,853 | B2 * | 7/2014 | Mitchell | H01Q 1/28 342/26 B |

OTHER PUBLICATIONS

U.S. Appl. No. 13/831,035, filed Mar. 14, 2013, James B. West et al.
Non-Final Office Action on U.S. Appl. No. 13/831,035, dated Feb. 5, 2015, 12 pages.

* cited by examiner

*Primary Examiner* — Hoang V Nguyen
(74) *Attorney, Agent, or Firm* — Donna P. Suchy; Daniel M. Barbieri

(57) ABSTRACT

Systems and methods for use in a vehicle are provided. A vehicle can be an aircraft, truck, ship, automobile, locomotive, etc. A system includes a housing having an exterior surface for housing sensor or communication equipment and interior surface for housing electronics associated with the equipment. The sensor or communication equipment can include a radar antenna mounted on or adjacent to the exterior surface, and at least one of a Satcom antenna, altimeter antenna, vision sensor or any communication link antenna.

20 Claims, 4 Drawing Sheets

MULTI-SENSOR SYSTEM AND METHOD FOR VEHICLES

CROSS-REFERENCE TO RELATED PATENT APPLICATIONS

The present application claims the benefit of and priority to and is a Continuation of U.S. application Ser. No. 13/831,035, filed on Mar. 14, 2013, entitled "MULTI-SENSOR SYSTEM AND METHOD FOR VEHICLES" by West et al., which is incorporated herein by reference in its entirety.

BACKGROUND

The present disclosure relates to a multi-sensor system and method for vehicles, such as aircraft. The electronic equipment often must be at least partially disposed on the outside of the vehicle to accomplish its intended function.

Various electronic equipment is utilized on vehicles. The electronic equipment often must be at least partially disposed on the outside of the vehicle to accomplish its intended function. For example, aircraft often include equipment that includes one or more components disposed outside the main fuselage. Such components can include an antenna for an aircraft radar system (such as a weather radar), sensors (e.g., millimeter radars, night vision sensors, targeting sensors, and enhanced vision sensors), antennae for satellite communications (L, Ku, Ka band), air-to-ground communication equipment (3G/4G communication systems), radio antennas, radar altimeters, etc.

Generally, radar systems have an antenna that is mechanically steered and disposed outside of the fuselage in a nose cone or radome. Conventional mechanically steered radar antennas often require large sweep volumes that preclude the use of real estate within the radome for other sensors and equipment. The use of space in the enclosed radome volume for other electronic equipment is desirable, especially as more electronic equipment is carried on aircraft.

The location of the radar antenna in the radome can also cause issues related to the narrow band of transmissivity associated with the radome. For example, standard air transport system class "sandwich" radomes do not electromagnetically accommodate both X band weather radar and millimeter wave imaging and electro-optical enhanced vision systems. Conventional radome material attenuates electromagnetic energy outside of the X-band range. There is a desire to reduce the volume and weight of the radome. This desire is particularly acute in smaller aircraft, such as, business and regional system (BRS) aircraft and military aircraft.

Electronic equipment outside of the aircraft is connected to electronics within the aircraft through holes in the fuselage. For example, the electronic equipment requires that power and data conductors pass through the holes in the fuselage or skin of the aircraft. Providing holes in the fuselage aircraft increases manufacturing costs and can affect the integrity of the fuselage. Further, providing holes in the fuselage requires that the holes be sealed in accordance with requirements for pressurized environments.

Thus, there is a need for a system of accommodating multiple sensors on a vehicle, such as an aircraft. Further, there is a need for a multi-sensor system which requires less weight and volume than conventional radome configurations. Further still, there is a need for a method of and system for deploying a weather radar antenna that is not inhibited by transmissiveness characteristics of the radome. There is also a need for a smart nose cone that can be retrofitted onto existing aircraft. Further, there is a need for a housing, such as a nose cone or radome, that includes antennas on its exterior structure for various systems. Further, there is a need for accommodating redundant equipment within the housing upon which antennas are mounted.

Accordingly, it would be advantageous to provide a multi-sensor pod that houses a number of electronic components, reduces volume and weight on the vehicle and reduces time required for replacement or repair.

SUMMARY

An exemplary embodiment relates to a system for a vehicle. The system includes a housing having an exterior surface, and at least two of a radar antenna, a satcom antenna, altimeter antenna, vision sensor, an air-to-ground communication antenna, a communication, navigation and surveillance (CNS) antenna, a directional data link antenna, or a ground-to ground communication antenna mounted on the exterior surface. An interior surface of the housing includes electronics for the at least two of the radar antenna, satcom antenna, altimeter antenna, vision sensor, an air-to-ground communication antenna, or a ground-to ground communication antenna. The housing being a structural component of the vehicle An exemplary embodiment of the disclosure relates to a system for a vehicle. The system including a nose cone housing having and external surface and an internal surface. The system also includes a radar antenna mounted to the external surface of the nose cone housing. The radar antenna can be comprised of a panel.

Another exemplary embodiment of the disclosure relates to a system for an aircraft. The system includes a housing having an exterior surface, a weather radar antenna mounted on the exterior surface, and at least one of a Satcom antenna, altimeter antenna, vision sensor or an air-to-ground communication antenna. The weather radar antenna is mounted at a first location on the housing and the at least one of a Satcom antenna, altimeter antenna, vision sensor or an air-to-ground communication antenna is mounted on the exterior surface at a second location. The second location is different than the first location.

Another exemplary embodiment of the disclosure relates to a method of providing a first antenna for a first system and a second antenna for a second system for a vehicle. The method includes attaching the first antenna at a first location on an exterior surface of a housing, attaching a second antenna on the exterior surface at a second location, and providing electronics for the first antenna and the second antenna within the housing. The method further includes attaching the housing to an exterior of the vehicle.

BRIEF DESCRIPTION OF THE DRAWINGS

The exemplary embodiments will become more fully understood from the following detailed description, taken in conjunction with the accompanying drawings, wherein like reference numerals refer to like elements, and.

DETAILED DESCRIPTION OF PREFERRED AND EXEMPLARY EMBODIMENTS

According to one exemplary embodiment, a multi-sensor system can be utilized to provide multiple electronic functions for a vehicle, such as, an aircraft, military vehicle, truck, automobile, etc. the multi-sensor system is provided as part of a structure of the vehicle in one embodiment. The structure includes a housing with an exterior surface and sensor and/or communication components are mounted on an exterior surface of the housing while an interior surface of the housing contains electronics for the components. The housing is a structural member of the vehicle. The housing can be part of an aerodynamic component, a bumper, a door, roof, a hatch, compartment, etc.

According to one exemplary embodiment, a multi-sensor system, such as, a smart nose cone, can be utilized to provide multiple electronic functions for a vehicle, such as, an aircraft. The nose cone can be in the shape or form of a radome and can be located at the front of an aircraft in one embodiment. Alternatively, the multi-sensor system can be configured as a multi-sensor suite pod and can be provided at various other exterior portions of a vehicle, such as, at the tail of an aircraft, on a bottom of the aircraft, on wings of the aircraft, etc. The pod can have a conical or non-conical, aerodynamic shape for attachment to various places on the aircraft.

Advantageously, the smart nose cone or multi-sensor suite pod provides a low cost multi-sensor fusion system appropriate for various vehicle markets including commercial system and government system aircraft markets. The smart nose cone or multi-sensor suite pod can be used with transport aircraft, military aircraft, business and regional system (BRS) aircraft, private aircraft, helicopters, drones, boats, ships, trains, trucks, automobiles, spacecraft or any vehicle. The smart nose cone or multi-sensor suite pod can advantageously utilize an exterior surface to house various sensor components, such as, antennas, to reduce volume and weight requirements aboard the aircraft for such systems in one embodiment. In addition, the use of a multi-sensor system allows easier retrofitting and requires fewer redundant components than separate conventional systems in one embodiment. Further, the multi-sensor system can advantageously reduce the number of holes in the aircraft fuselage required by electronic equipment in one embodiment.

Figure 1A:
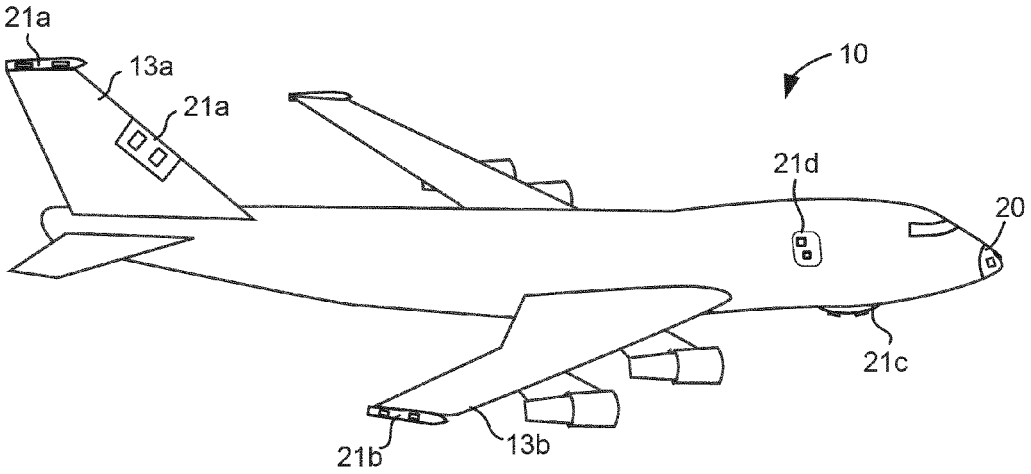
FIG. 1*a* is a side view of an aircraft with a multi-sensor system in several locations in accordance with exemplary embodiment.

With reference to FIG. 1*a*, an aircraft 10 includes one or more of multi-sensor systems 20 and 21*a-d*. Multi-sensor system 20 and systems 21*a-d* can include a housing, a number of antennas, at least one sensor and electronics. Antennas can be mounted on exterior surface of the housing. An interior surface of the housing can define a cavity for housing electronics associated with the antennas and sensors. Multi-sensor systems 21*a-d* can be similar system 20 discussed below.

The housing is provided as a structural member of aircraft 10 in one embodiment. For example, multi-sensor system 20*a* is embodied as a nose cone, and multi-sensor systems 21*a* are provided at locations on a vertical fin 13*a* of aircraft 10. According to another example, multi-sensor system 20*b* is embodied as a structural member on a wing 13*b* of aircraft 10, and multi-sensor system 20*c* is embodied as a structural member on the bottom of the fuselage of aircraft 10. According to another example, multi-sensor system 20*d* is embodied as a door or hatch of aircraft 10.

Figure 1B:
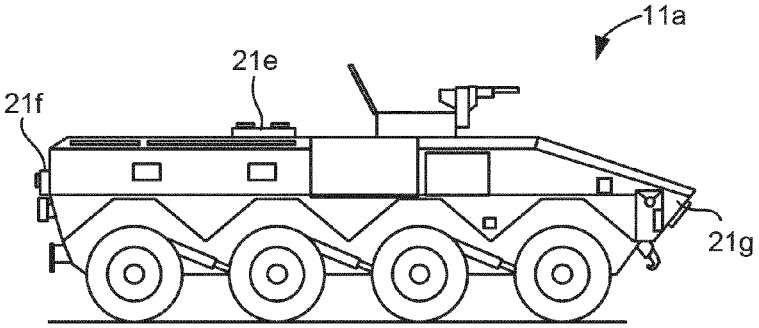
FIG. 1*b* is a side view of a military vehicle with a multi-sensor system in several locations in accordance with exemplary embodiment.

With reference to FIG. 1*b*, a military vehicle 11*a* includes one or more of multi-sensor systems 21*e-g*. Multi-sensor systems 21*e-g* can include a housing, a number of antennas, at least one sensor and electronics. Antennas can be mounted on exterior surface of the housing. An interior surface of the housing can define a cavity for housing electronics associated with the antennas and sensors. Multi-sensor systems 21*e-g* can be similar system 20 having antennas and sensors for military applications in one embodiment.

The housing is provided as a structural member of vehicle 11*a* in one embodiment. For example, multi-sensor system 21*e* is embodied as a hatch, and multi-sensor system 21*g* is embodied as a front portion of vehicle 11*a*. According to another example, multi-sensor system 20*f* is embodied as a structural member on a rear portion of vehicle 11*a*.

Figure 1C:
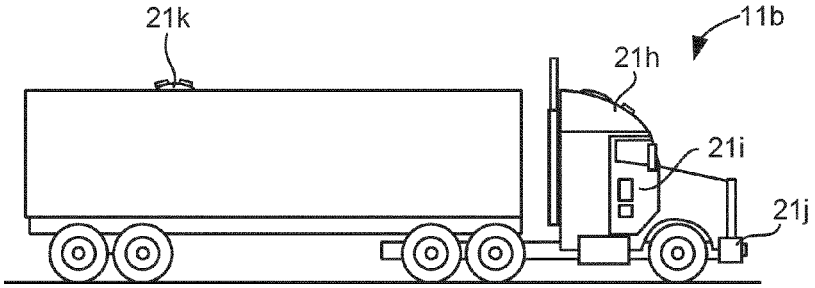
FIG. 1*c* is a side view of a truck with a multi-sensor system in several locations in accordance with exemplary embodiment.

With reference to FIG. 1*c*, a vehicle such as a truck 11*b* includes one or more of multi-sensor systems 21*h-k*. Multi-sensor system 20 can include a housing, a number of antennas, at least one sensor and electronics. Antennas can be mounted on exterior surface of the housing. An interior surface of the housing can define a cavity for housing electronics associated with the antennas and sensors. Multi-sensor systems 21*h-k* can be similar system 20 having antennas and sensors for transportation applications in one embodiment.

The housing is provided as a structural member of vehicle 11*b* in one embodiment. For example, multi-sensor system 21*i* is embodied as a part of a door, and multi-sensor system 21*h* is embodied as spoiler above the cab of the vehicle 11*b*. According to another example, multi-sensor system 20*k* is embodied as a structural member on a top portion of the trailer of vehicle 11*a*, and multi-sensor system 21*h* is embodied as bumper of the vehicle 11*b*. Alternative structural elements (e.g., hoods, spoilers, mirrors, tailgates, horizontal stabilizers, etc.) and locations associated with aircraft 10, military vehicle 11*a*, truck 11*b* can be used for the multi-sensor systems 21*a*-1 and 20.

Figure 1D:
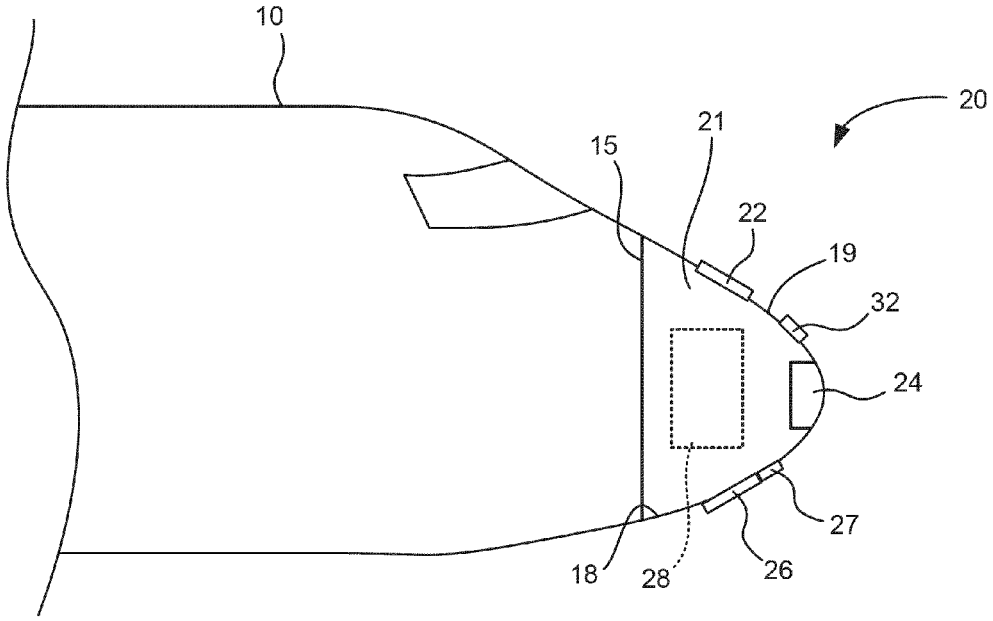
FIG. 1*d* is a fragmentary side view of an aircraft with a multi-sensor system embodied as a nose cone in accordance with exemplary embodiment.

With reference to FIG. 1*d*, aircraft 10 includes multi-sensor system 20 embodied as a smart nose cone. Multi-sensor system 20 can include a housing 21, antennas 22, 24, 26 and 27, at least one sensor 32 and electronics 28. Antennas 22, 24, 26 and 27 can be mounted on exterior surface 19 of housing 21. An interior surface 18 of housing 21 can define a cavity for housing electronics 28. The cavity can be defined on one end by bulkhead wall 15 of aircraft 10 (e.g., main fuselage of aircraft 10). Alternatively, housing 21 can include a wall at bulkhead wall 15 of aircraft 10 and be a completely enclosed housing 19.

Electronics 28 are shown as one block in FIG. 1*d* but can be multiple components associated with systems for antennas 22, 24, 26 and 27 and sensor 32. Electronics 28 can include transmit/receive circuits, power supplies, data communication circuits, modems, interface circuits, computers, memory, processors, etc. Sensor 32 can be any type of sensor useful for a vehicle. Aircraft 10 can include several sensors, such as cameras, targeting sensors, vision sensors, temperature sensors, speed sensors, etc.

In one embodiment, electronics 28 can include radio frequency (RF) processing components for the sensor electronics suite associated with system 20. Electronics 28 can also include optical conversion circuits so that electrical signals from electronics 28 can be converted to optical signals and optical signals can be converted to electric signals for electronics 28 in one embodiment. According to this embodiment, optical data signals as opposed to electronic data signals are provided through the fuselage of aircraft 10.

Advantageously, redundant components can be shared for each of systems associated with antennas 22, 24, 26 and 27 and sensor 32. For example, only two redundant power supplies may be required for all of the electronics associated with antennas 22, 24, 26 and 27 and sensor 32 rather than separate redundant power supplies being required for each as in conventional systems which do not use a multi-sensor configuration. Further, redundant memory, processing circuits, input/output, RF circuits, and data circuits can also be saved by sharing the electronics for the systems associated with antennas 22, 24, 26 and 27 and sensor 32. In one embodiment, mechanically steered antenna systems are eliminated from the interior of housing 21, thereby eliminating the requirement of pressurizing a radome and providing more real estate for electronics 28.

Antenna 22 can be an electronic array scanning antenna for a Satcom system and is generally upwardly disposed on housing 21. Antenna 24 can be a weather radar antenna for a weather radar and is generally forwardly disposed on a forward portion of housing 21. Antenna 26 can be for a radar altimeter and antenna 27 can be for a 3G or 4G communication system. Antennas 26 and 27 are generally downwardly disposed on housing 19. Sensor 32 can also be a vision system sensor, such as, an enhanced vision system sensor. One or more of antennas 22, 24, 26, and 27 can be conformally mounted on exterior surface 19 in one embodiment. Sensor 32 can be conformally provided on surface 21 and is disposed for forward viewing. Additional electronic devices such as other sensors can be added to surface 21.

The configuration, arrangement, and operation of multi-sensor systems 20 and 20*a-k* are intended to reduce or minimize the required space and weight, improve performance, expand functionality, and reduce potential failure, malfunction, or normal wear, and reduce repair and assembly time in one embodiment. In one embodiment, components on systems 20 and 21*a-k* can be pre-aligned before final assembly. Each system 20-20*a-i* can be entirely completed without the vehicle being present, thereby allowing remote construction of sensor system 10.

Antenna 24 is a panel antenna and can be a low-cost silicon-germanium (SiGe) based active electronically scanned array ("AESA") antenna in one embodiment. The panel antenna can be a faceted planer AESA panel system with environmentally robust protective super substrate (e.g., Astroquartz). The panel antenna can include two or more faceted silicon-germanium panels in one embodiment. Antenna 24 configured as an electronically steered antenna as opposed to a mechanically steered antenna advantageously eliminates the need for motor and motor drivers, thereby reducing the weight and costs associated with weather radar systems.

Antenna 24 can be conformal to the front-conical portion of housing 19. Pockets can be provided on exterior surface 21 of housing 19 for receiving the panels associated with antenna 24 in one embodiment.

According to one embodiment, antenna 24 can be embodied as a conformal electronically scanned array (ESA) structures, or as an ultra-broad band multi-mode esa, such as a balanced anti-podal vivaldi antenna (BAVA). The structure can be configured as a single or double curved surface comprised of piece-wise fragments abutted together to meet aerodynamic requirements in one embodiment. The structure can include a dielectric covering that is environmentally robust. In one embodiment, antenna 24 can be built up during fabrication of housing 19.

According to another embodiment, antenna 24 can be embodied as a dielectric and metallic composition organically grown on surface 21 of housing 19 to provide a structurally integrated antenna similar to antennas used in Dept. of Defense (DOD) applications. Antenna 24 can include high precision and high resolution phase shifters for calibrating non-uniformities out of the radiation aperture in one embodiment.

Antenna 24 can be configured for use in multiple frequency band operation, such as for use in high altitude ice sensing applications in one embodiment. Three dimensional synthetic apertures can be obtained by vectoring summation of AESA panels. Frequency Selective Surface (FSS) super substrates and edge treatment for resistive loading can be used to help control radar cross section for low observable applications.

Antenna 22 can be an conformal AESA similar to antennas 24. In one embodiment, antenna 22 can be an ultra light antenna having an aperture from 2 GHz to 18 GHz and can be used for multiple radio systems.

Signal distribution paths for bias, control and RF signal distribution can be embedded in the structure of housing 19. The signal paths can be embodied as photonic lines, RF coaxial strip lines, waveguide conductors, twisted shield pairs, differential high speed digital buses, etc. In this embodiment, housing 19 is no longer an electromagnetic transmissive window which houses a mechanical-based antenna, but rather is a three dimensional aerodynamic mechanical support structure that holds antenna 22, 24, 26 and 27 as well as sensor system 32 to optimize subsystem functionality. Housing electronics 28 within surface 18 reduces breaches of the fuselage (e.g., a pressurized vessel).

Antenna 26 can be a conventional radar altimeter antenna or a panel antenna. Sensor 22 can be conformally applied to a top surface of housing 19 in one embodiment.

In one embodiment, antennas 26 and 27 can be similar to antennas 22 and 24 and can be advanced printed array panels implemented in RF printed wiring board technology with environmentally robust super-substrate. Antennas 22, 24, 26, and 27 can be disposed in pockets at respective locations on housing 19. Advantageously, antennas 22, 24, 26 and 27 can be easily replaced by replacing the antenna into the pocket on housing 19.

Housing 19 can be advantageously retrofitted onto existing aircraft with conventional radomes. Housing 19 can replace a conventional radome and include the additional electronics for a low assembly time and ease of changing of equipment.

In one embodiment, multi-sensor system 20 can be configured for particular missions or applications and can be swapped out on a mission by mission basis. For example, certain sensors or certain radars may be required for certain missions, while others are not. Various configurations of system 20 can be utilized so that the appropriate mix of sensors and radars is provided on a number of housings 19.

Figure 2:
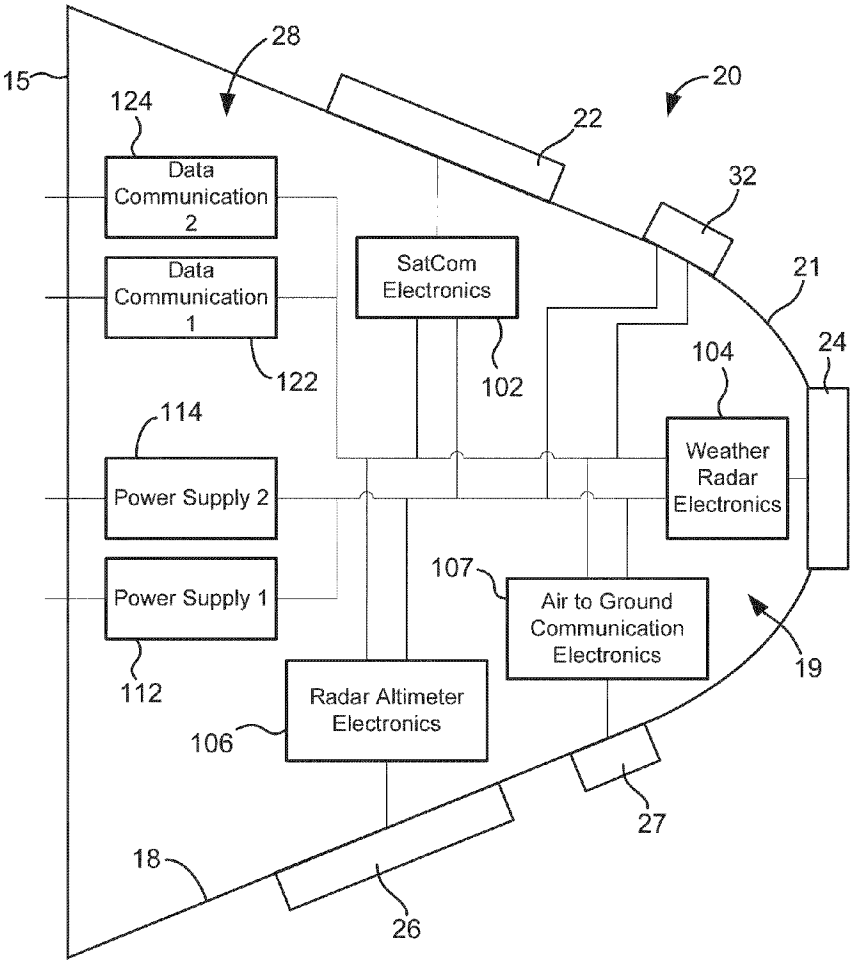
FIG. 2 is a general block diagram of the multi-sensor system illustrated in FIG. 1*d*, including electronic components for the aircraft in accordance with another exemplary embodiment.

With reference to FIG. 2, housing 19 can include electronics 28 including weather radar electronics 104, SAT electronics 102, radar altimeter electronics 106, ground communication electronics 107, a first power supply 112, a second power supply 114, a first data communication circuit 122 and a second data communication circuit 124. Electronics for sensor 32 can also be provided in housing 19. Power supplies 112 and 114 are redundant and can be utilized to power multiple electronics 102, 104, 106, 107, circuits 122 and 124, and sensor 32. Circuits 122 and 124 can also be redundant circuits and can be shared in a similar manner. Additional redundant and non-redundant circuits can also be shared. In one embodiment, common power busses and aircraft interface busses can support a wide range of functions in individual modular suites such as nose cone suites.

By providing electronics 28 within housing 19 and sharing power supplies 112 and 114 and data communication circuits 122 and 124, fewer holes can be required through the bulkhead wall 15. Various circuits can be hard mounted to the bulkhead wall 15 of aircraft 10, allowing greater design freedom for thermal management, weight distribution, etc. In certain embodiments, electronics 28 within housing 19 can be combined into a single line replaceable unit. In one embodiment, lengthy fiber optic, RF signal, control, and power line runs along the fuselage of aircraft 10 can be mitigated by placing electronics near bulkhead wall 15.

Antennas for individual functions can be mounted either on the outside of the nose-cone assembly or inside the nose-cone with the mechanical-nose cone being used as an electromagnetic window for the sensor function. Individual sensor alignment or sensor to sensor alignment can be executed at the entire nose-cone module level. Preplanned sensor configurations can be optimized for maximum volume usage without the constraint of aircraft line replaceable unit (LRU) maintenance access.

Figure 3:
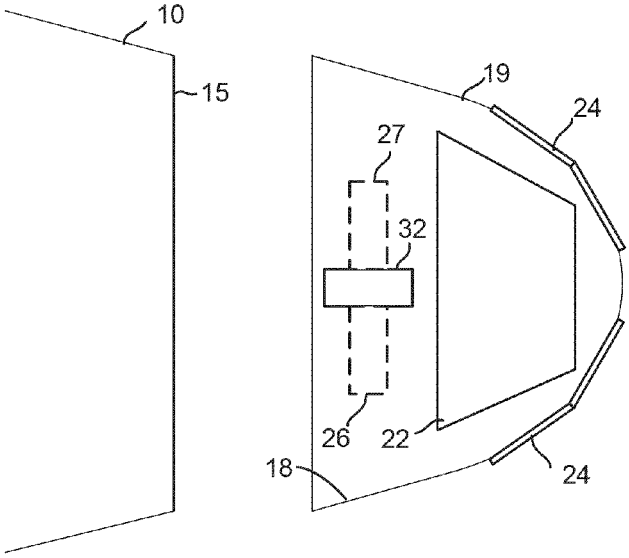
FIG. 3 is a top view of the multi-sensor system illustrated in FIG. 1*d* according to another exemplary embodiment.

With reference to FIG. 3, multi-sensor system 20 is shown detached from aircraft 10. Weather radar antenna 24 can be configured as two faceted panels at a front end of surface 21 of housing 19. Each faceted panel includes two sub panels in one embodiment. The panels can be faceted vertically, horizontally, or both vertically and horizontally depending upon geometric criteria. Two panels are used to reduce off-axis scan loss in one embodiment. Antenna 22 is an upward looking antenna for satcom applications, and sensor 32 is a conformal EVS sensor provided on a top portion of surface 21. System 32 can be provided behind antenna 22 in one embodiment. A radar altimeter or antenna 26 for the radar altimeter can be provided on a bottom portion of surface 21. Antenna 27 can be provided near antenna 26. In one embodiment, panels of antenna 24 can be steered independently and operate at different frequencies. A spectrum of multi-beam frequencies and polarizations are possible using antenna 24. According to an alternative embodiment, antennas for certain individual functions can be mounted inside the nose-cone with the mechanical-nose cone being used as an electromagnetic window.

Figure 4:
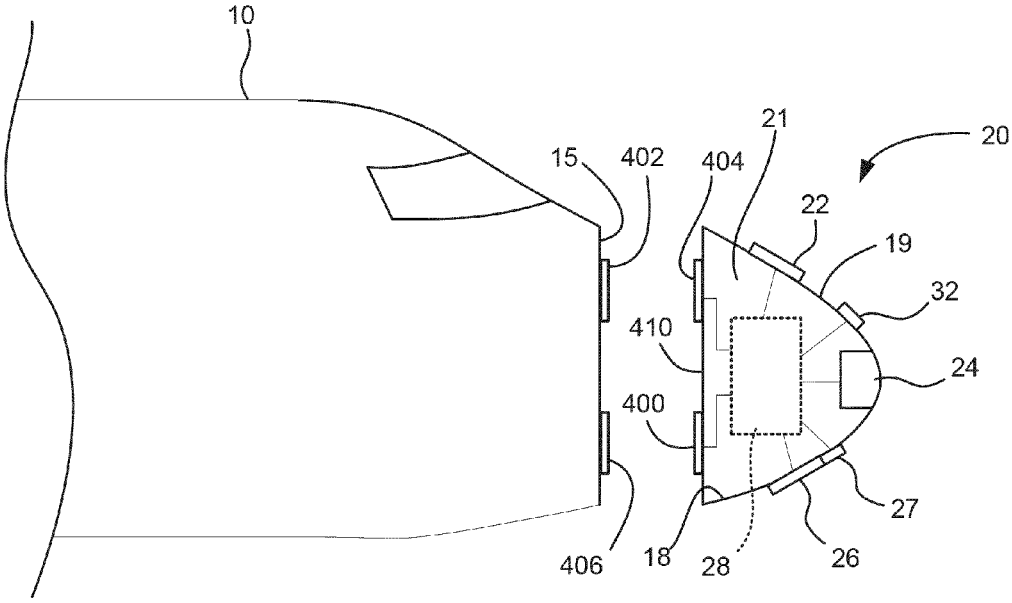
FIG. 4 is a fragmentary side view of an aircraft with the multi-sensor system illustrated in FIG. 1*d* including connectors on a bulkhead wall of the aircraft according to yet another exemplary embodiment.

With reference to FIG. 4, multi-sensor system 20 is shown detached from bulkhead wall 15 and can include a wall 410 that interfaces with bulkhead wall 15. Wall 410 can include connectors 404 and 400 disposed to interconnect with connectors 402 and 406 on bulkhead wall 15. Sensor system 20 can be attached to bulkhead wall 15 by fasteners (e.g., bolts, clamps, rivets, etc.) or adhesives. In one embodiment, wired connectors can extend from electronics 28 and attach to connectors 402 and 406 embodied as fixed connectors on bulkhead wall 15. Alternatively, connectors 402 and 406 and 404 and 408 can be embodied as wired connectors that can extend from multi-sensor system 20 and bulkhead wall 15. Although a set of two connectors are shown in an exemplary fashion, any number of connectors can be utilized without departing from the scope of the invention.

According to one embodiment, electronics 28 can include an electro-optical converter circuit such that optical signals are provided between aircraft 10 and electronics 28. The optical signals can be control signals and data signals provided between aircraft 10 and electronics 28. The optical signals can be provided through optical windows or lenses on wall 410 or bulkhead wall 15. Alternatively, fiber optic cables and bulkhead connectors can be provided through wall 410 and bulkhead wall 15.

The term "antenna" and "electronics" are intended to be broad terms and not terms of limitation. These components may be used with any of a variety of products or arrangements. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. Such joining may also relate to mechanical or electrical relationship between the two components.

It is also important to note that the construction and arrangement of the elements of the mounting apparatus as shown in the preferred and other exemplary embodiments are illustrative only. Although only a few embodiments of the present invention have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the claims. Accordingly, all such modifications are intended to be included within the scope of the present invention as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and/or omissions may be made in the design, operating conditions and arrangement of the preferred and other exemplary embodiments without departing from the spirit of the present invention as expressed in the appended claims.

What is claimed is:

1. A system for a vehicle, the system comprising:

a first conical housing comprising a first external surface, a first interior surface, first electronics, and a first radar antenna disposed on the first external surface, the first radar antenna being comprised of at least one first panel, the first electronics being disposed within the first interior surface, the first radar antenna and the first electronics being for a first mission type; and a second conical housing comprising a second external surface, a second interior surface, second electronics, and a second radar antenna disposed on the second external surface, the second radar antenna being comprised of at least one second panel, the second electronics being disposed within the second interior surface, the second radar antenna and the second electronics being for a second mission type, wherein the first housing and the second housing are configured to be attached to and removed from the vehicle at a same area.

2. The system of claim 1 wherein the first and second conical housings each comprise a mechanically moving weather radar antenna and weather radar electronics disposed within the respective first interior surface or second interior surface.

3. The system of claim 2, wherein the first radar antenna is comprised of at least two faceted panels.

4. The system of claim 1, wherein the first and second conical housings each comprise an upward looking Satcom array antenna.

5. The system of claim 4, wherein the first and second conical housings each comprise at least one vision sensor conformally mounted on a top area.

6. The system of claim 5, wherein the first and second conical housings each comprise a radar altimeter mounted on a bottom area.

7. The system of claim 1, wherein the first and second conical housings each comprise an air-to-ground 3G antenna mounted on a bottom surface.

8. The system of claim 1, wherein the first conical housing and the second conical housings are configured for attachment to a same area on the vehicle.

9. The system of claim 1, wherein the first radar antenna includes a printed antenna array.

10. The system of claim 1, wherein an interior of each of the first and second housings is unpressurized and the vehicle is an aircraft.

11. A system for a vehicle, the system comprising:

a first housing comprising a first exterior surface, a first interior surface, at least four of a first radar antenna, a first Satcom antenna, a first altimeter antenna, a first vision sensor, a first air-to-ground communication antenna, a first communication, navigation and surveillance (CNS) antenna, a first directional data link antenna, and a first ground-to-ground communication antenna mounted on the first exterior surface of the first housing, wherein first electronics for the at least four of the first radar antenna, the first Satcom antenna, the first altimeter antenna, the first vision sensor, the first air-to-ground communication antenna, the first communication, navigation and surveillance (CNS) antenna, the first directional data link antenna and the first ground-to-ground antenna are disposed within the first interior surface of the first housing, the first housing being a structural member of the vehicle; and a second housing comprising a second exterior surface, a second interior surface, and at least three of a second radar antenna, a second Satcom antenna, a second altimeter antenna, a second vision sensor, a second air-to-ground communication antenna, a second communication, navigation and surveillance (CNS) antenna, a second directional data link antenna, and a second ground-to-ground communication antenna mounted on the second exterior surface of the second housing, wherein electronics for the at least three of the second radar antenna, the second Satcom antenna, the second altimeter antenna, the second vision sensor, the second air-to-ground communication antenna, communication, navigation and surveillance (CNS) antenna, the second directional data link antenna and the second ground-to-ground antenna is disposed within the second interior surface of the second housing, the second housing being a structural member of the vehicle, wherein the first housing and the second housing are configured to be attached to and removed from the vehicle at a same area.

12. The system of claim 11, further comprising a power supply capable of use with the first electronics for the first radar antenna and for at least one of a Satcom antenna, altimeter antenna, vision sensor, or 3G-4G air-to-ground antenna.

13. The system of claim 11, wherein the first radar antenna is provided at a first location in a front location.

14. The system of claim 11, wherein the first housing comprises each of the first Satcom antenna, the first altimeter antenna, the first vision sensor, and the first air-to-ground communication antenna.

15. A method of exchanging first mission equipment for second mission equipment on a vehicle, the method comprising:

detaching a first conical housing from the vehicle, the first conical housing comprising a first external surface, a first interior surface, first electronics, and a first radar antenna, the first radar antenna and the first sensor antenna being disposed on the first external surface, a first sensor antenna, the first radar antenna being comprised of at least one first panel, the first electronics being disposed within the first interior surface, the first sensor antenna and the first electronics being for a first mission type; and attaching a second conical housing to the vehicle, the second conical housing comprising a second external surface, a second interior surface, second electronics, a second sensor antenna, and a second radar antenna, the second radar antenna and the second sensor antenna being mounted to the second external surface, the second radar antenna being comprised of at least one second panel, the second electronics being disposed within the second interior surface, the second sensor antenna and the second electronics being for a second mission type.

16. The method of claim 15, wherein the first conical housing further comprises a mechanically moving weather radar.

17. The method of claim 15, wherein the second sensor antenna is a communication sensor.

18. The method of claim 15, wherein the first radar antenna is a faceted antenna.

19. The method of claim 15, wherein the first conical housing comprises an end wall, and the first conical housing is detached using bolts provided through the end wall to a fuselage of the vehicle.

20. The method of claim 15, wherein the second conical housing further comprises an enhanced vision sensor disposed on the second exterior surface.

* * * * *